US011622576B2

(12) United States Patent
Liu et al.

(10) Patent No.: US 11,622,576 B2
(45) Date of Patent: Apr. 11, 2023

(54) ELECTRONIC CIGARETTE

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Hong Yu, Hunan (CN); Yuangang Dai, Hunan (CN); Xinqiang Yin, Hunan (CN); Jianhua Yi, Hunan (CN); Yongquan Zhou, Hunan (CN); Youlin He, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 568 days.

(21) Appl. No.: 16/651,307

(22) PCT Filed: Sep. 30, 2018

(86) PCT No.: PCT/CN2018/109059
§ 371 (c)(1),
(2) Date: Mar. 26, 2020

(87) PCT Pub. No.: WO2019/063008
PCT Pub. Date: Apr. 4, 2019

(65) Prior Publication Data

US 2020/0221776 A1 Jul. 16, 2020

(30) Foreign Application Priority Data

Sep. 30, 2017 (CN) ..... 201721283473.2
Sep. 30, 2017 (CN) ..... 201721283656.4

(51) Int. Cl.
*A24F 47/00* (2020.01)
*A24F 40/05* (2020.01)
(Continued)

(52) U.S. Cl.
CPC ..... *A24F 40/05* (2020.01); *A24F 7/00* (2013.01); *A24F 40/42* (2020.01); *A24F 40/44* (2020.01);
(Continued)

(58) Field of Classification Search
CPC ..... A24F 40/40; A24F 40/42
See application file for complete search history.

(56) References Cited

U.S. PATENT DOCUMENTS

2017/0027228 A1* 2/2017 Rastogi ..... A24F 40/40

FOREIGN PATENT DOCUMENTS

CN 2691434 Y 4/2005
CN 204949516 U 1/2016
(Continued)

OTHER PUBLICATIONS

International Search Report issued in international Application No. PCT/CN2018/109059 dated Nov. 22, 2018, 2 pages.

*Primary Examiner* — Eric Yaary
(74) *Attorney, Agent, or Firm* — Mauriel Kapouytian Woods LLP; Liang Huang

(57) ABSTRACT

An electronic cigarette, comprising a housing and a suction nozzle, the housing provided with a support. The electronic cigarette further comprises a top cover capable of covering an opening of the housing, the suction nozzle is disposed at the top of the top cover, one end of the top cover is connected to the support through a rotating shaft, a clamping rib is disposed at the bottom of the top cover, and a locking mechanism connected to the clamping rib by locking and an elastic mechanism for opening the top cover when the
(Continued)

locking mechanism is separated from the clamping rib are also disposed in the housing; the locking mechanism comprises a key handle, a transmission and a first spring, and one end of the key handle is connected to the transmission.

15 Claims, 8 Drawing Sheets

(51) Int. Cl.

| | |
|---|---|
| ***A24F 40/48*** | (2020.01) |
| ***A24F 40/44*** | (2020.01) |
| ***A24F 40/42*** | (2020.01) |
| ***A24F 40/50*** | (2020.01) |
| ***A24F 7/00*** | (2006.01) |
| ***H01R 33/20*** | (2006.01) |
| ***A24F 40/485*** | (2020.01) |
| *A24F 40/10* | (2020.01) |

(52) U.S. Cl.
CPC ..... *A24F 40/48* (2020.01); *A24F 40/485* (2020.01); *A24F 40/50* (2020.01); *H01R 33/205* (2013.01); *A24F 40/10* (2020.01)

(56) References Cited

FOREIGN PATENT DOCUMENTS

| | | | |
|---|---|---|---|
| CN | 207252791 | U | 4/2018 |
| CN | 207306086 | U | 5/2018 |
| WO | 2014040915 | A1 | 3/2014 |

* cited by examiner

ELECTRONIC CIGARETTE

CROSS REFERENCE TO RELATED APPLICATIONS

This application is a U.S. National Phase application under 35 U.S.C. § 371 of International Application No. PCT/CN2018/109059 filed on Sep. 30, 2018, which claims priority to Chinese Application Number 201721283656.4 filed on Sep. 30, 2017 and Chinese Application Number 201721283473.2 filed on Sep. 30, 2017. The entire contents of these applications are hereby incorporated herein by reference.

FIELD OF THE INVENTION

The present invention particularly relates to an electronic cigarette.

BACKGROUND OF THE INVENTION

The existing electronic cigarette includes a housing, a support in the housing, a key PC board fixed on the support, and a suction nozzle at one end of the housing, and has the following disadvantages:

First, the suction nozzle is connected to the housing by thread tightening, and the suction nozzle is often rotated, so threads are easily worn to cause slipping, the connection method is unreliable, the use cost is increased, and the operation is not convenient.

Second, in order to increase the contact area of the hand operating the key PC board and avoid finger discomfort caused by the key, an electronic cigarette using a side panel of the housing as a key shell has appeared, wherein the bottom of the key shell is rotatably connected to the support through a shaft, a raised portion capable of abutting against the key PC board is provided at the bottom of the inner lateral surface of the key shell, and the key shell can rotate about the shaft and drive the raised portion to abut against the key PC board so as to control the circuit of the electronic cigarette to be closed. Since the side panel of the housing is used as the key shell, the force area of the key shell is large, the key shell is very easily deformed and deflected due to non-uniform force, the raised portion at the bottom of the key shell cannot abut against the key PC board, the switch of the key PC board cannot be effectively triggered, the operational reliability is low, and the user experience is poor.

Third, the phenomena of sucking liquid and scalding the mouth due to excessively high temperature of smoke often occur during smoking.

SUMMARY OF THE INVENTION

Aiming at the disadvantages of the prior art, the present invention provides an electronic cigarette, where the connection between a suction nozzle and a housing is reliable, the operation is convenient, the trigger efficiency of a key PC board is high, the reliability is high, and the problems of sucking liquid and scalding the mouth by smoke are solved, so the user experience is good.

In order to solve the above technical problems, the technical solution adopted by the present invention is as follows:

An electronic cigarette is provided, including a housing and a suction nozzle, the housing is provided with a support, wherein the electronic cigarette further includes a top cover capable of covering an opening of the housing, the suction nozzle is disposed at the top of the top cover, at least one end of the top cover is rotatably connected to the support, a clamping rib is disposed at the bottom of the top cover, and a locking mechanism connected to the clamping rib by locking is also disposed in the housing.

With the above structure, when the locking mechanism locks the clamping rib, the top cover covers the inside or outside of opening of the housing; and when the locking mechanism unlocks the clamping rib, the top cover can be opened to disconnect the suction nozzle from the housing. Since the locking mechanism is used to lock the top cover to realize the indirect connection between the suction nozzle and the housing, thread tightening is avoided, and the problem that threads are worn to cause slipping is also avoided. At the same time, the locking mechanism is used to lock or unlock the clamping rib, so the operation is convenient, the connection is reliable, and the cost is low. When the top cover is opened, an atomization assembly and the like can be put into the housing or taken out, so the operation is simple, convenient and reliable.

Further, an elastic mechanism for opening the top cover when the locking mechanism is separated from the clamping rib is also disposed in the housing.

With the above structure, when the locking mechanism unlocks the clamping rib, the elastic force of the elastic mechanism opens the top cover, so the operation is convenient.

As a preferred manner, at least one end of the top cover is rotatably connected to the support through a rotating shaft, the elastic mechanism includes a torsion spring between the support and the housing, and the torsion spring is sleeved outside the rotating shaft.

As a preferred manner, the locking mechanism includes a key handle, a transmission and a first spring, and the transmission has a buckling portion corresponding to the clamping rib; the transmission and the first spring are disposed on the support, one end of the key handle is connected to the transmission, and the other end of the key handle passes through the housing and is exposed.

With the above structure, when the top cover seals the opening of the housing, the buckling portion and the clamping rib are locked with each other; and when the key handle is pushed inward, the key handle drives the transmission to move inward and causes the buckling portion and the clamping rib to be unlocked, and the key handle compresses the first spring. When the key handle is pressed by an external force, the transmission moves toward the inside of the electronic cigarette along with the key handle, then the buckling portion on the transmission is separated from the clamping rib on the top cover, the locking portion is unlocked from the clamping rib, the top cover flips under the torsion of the torsion spring, that is, the top cover is opened by flipping, and the atomization assembly and the like can be taken out from the housing and be replaced, or the receiving chamber for placing the atomization assembly can be cleaned, thereby improving the user experience. When the key handle is released, the key handle and the transmission are reset under the restoring force of the first spring. When the top cover is closed, the buckling portion locks the clamping rib to stabilize the top cover, thereby preventing the atomization assembly from automatically popping up to affect the smoking effect.

As a preferred manner, two clamping ribs are symmetrically disposed at the bottom of the top cover, and two locking mechanisms are correspondingly disposed in the housing.

The locking mechanisms are disposed on two sides of the electronic cigarette, each key handle is disposed independently, and when a user needs to open the top cover to replace the atomization assembly, the top cover can be opened by pressing the key handles on two sides at the same time, which is in line with human operating habits, so the operation is simple and convenient, the force is uniform, and the top cover can be opened without being stuck or locked.

Further, a side panel of the housing is a key shell detachably connected to the housing, the bottom of the key shell is rotatably connected to the support through a key shaft, the upper part of the key shell is connected to a linkage block on the support by transmission, the linkage block is provided with a raised portion capable of abutting against a key PC board, and a second spring is disposed between the linkage block and the key PC board.

With the above structure, since the key shaft connected to the upper part of the key shell by transmission is provided, the force applied to the key shell is concentrated on a movable member, and the movable member abuts against the key PC board to turn on the circuit. At the same time, according to the principle of leverage, this control method not only concentrates the force, but also saves time and effort, is better in hand feel, and enhances the user experience.

As a preferred manner, two first grooves are symmetrically formed on two inner sides of the key shell, the linkage block is provided with two protrusions corresponding to the first grooves, and the support is provided with two second grooves corresponding to the protrusions.

Two first grooves are symmetrically formed on two inner sides of the key shell, the linkage block is provided with two protrusions corresponding to the first grooves, and the protrusions move in corresponding second grooves. The first grooves cooperate with the protrusions to prevent the key shell from being disconnected from the linkage block. At the same time, because the first groove and protrusion matching structures are symmetrically arranged, when the key shell is subjected to an external force, the key PC board is stressed uniformly, the hand feel of the key is improved, more effort is saved, the efficiency of abutting against the switch on the key PC board is higher, and the phenomenon of locking due to uneven force is avoided.

Further, a fixed block is also disposed on the support, one of the two second grooves is an oval groove formed in the support, and the other one of the two second grooves is an oval groove formed by a semi-oval groove in the fixed block and a semi-oval groove in the support.

An oval groove is defined by the fixed block and the support, which is convenient for assembly.

Further, the electronic cigarette includes an atomization assembly, the support is provided with a receiving chamber for placing the atomization assembly, a first electrode electrically connected to one pole of the atomization assembly is disposed at the bottom of the receiving chamber, and a second electrode electrically connected to the other pole of the atomization assembly is disposed at the bottom of the receiving chamber.

When the atomization assembly is placed in the receiving chamber and the top cover is closed, two poles of the atomization assembly are in contact with the first electrode and the second electrode respectively, and the working circuit is connected.

Further, the top cover abuts against the first electrode and the second electrode through the atomization assembly.

The atomization assembly of the electronic cigarette is squeezed and locked by the top cover, so that the atomization assembly is electrically connected to the first electrode and the second electrode in the support stably.

Further, a third spring is also disposed in the housing, one end of the third spring abuts against the first electrode, and the other end of the third spring abuts against the support.

Further, a fourth spring is also disposed in the housing, one end of the fourth spring abuts against the second electrode, and the other end of the fourth spring abuts against the support.

After the top cover is locked by the locking mechanism, the top cover compresses the third spring corresponding to the first electrode through the atomization assembly, and the top cover compresses the fourth spring corresponding to the second electrode through the atomization assembly, so that the atomization assembly automatically pops up after the top cover is opened, the operation is simple, and the atomization assembly is convenient to be take out or be mounted. At the same time, since the atomization assembly and the first electrode or the second electrode are in flexible contact, rigid contact is avoided, and the conductive reliability is high.

As a preferred manner, the atomization assembly includes a shell; a liquid chamber, a liquid guiding mechanism and an ultrasonic atomization sheet are disposed in the shell; the liquid chamber is communicated with an atomization surface of the ultrasonic atomization sheet through the liquid guiding mechanism, one electrode layer of the ultrasonic atomization sheet is electrically connected to the first electrode, and the other electrode layer of the ultrasonic atomization sheet is electrically connected to the second electrode.

Further, a first tube is also disposed in the shell, the first tube has a baffle portion at one end, the liquid chamber is on one side of the baffle portion, the liquid guiding mechanism is on the other side of the baffle portion, and the liquid chamber is communicated with the liquid guiding mechanism only through a first through hole in the baffle portion.

Because the liquid chamber is communicated with the liquid guiding mechanism only through the first through hole in the baffle portion, liquid is guided relatively slow, which can avoid the phenomenon of liquid immersion of the ultrasonic atomization sheet when the electronic cigarette is not used for a long time, the starting speed of the ultrasonic atomization sheet is improved, and the phenomenon that the user easily sucks the liquid during smoking is avoided.

Further, a second tube is disposed in the first tube, the other end of the first tube and one end of the second tube are both connected to one end of the shell through a connector, a cavity is formed in the connector, the cavity is communicated with the outside through a second through hole in the connector, a channel is formed between the first tube and the second tube, and the cavity, the channel, the atomization surface of the ultrasonic atomization sheet, the inner cavity of the second tube, and the suction nozzle are communicated in sequence.

With the above structure, since the cavity is disposed at the air outlet end of the second tube, the air in the cavity will absorb part of the heat of airflow flowing through the air outlet end of the second tube, thereby reducing the temperature of the airflow flowing out from the suction nozzle, and preventing scalding the mouth; at the same time, the air in the cavity reaches the atomization surface of the ultrasonic atomization sheet through the channel, thereby preventing cold air from directly reaching the atomization surface of the ultrasonic atomization sheet, and improving the working efficiency and atomization amount of the ultrasonic atomization sheet.

Compared with the prior art, the present invention has the advantages that the connection between the suction nozzle and the shell is reliable, the operation is convenient, the efficiency of triggering the key PC board is high, the reliability is high, the time and effort are saved, the starting speed of the ultrasonic atomization sheet is high, the working efficiency is high, the smoke is stable, suction of liquid or mouth scald is avoided, and the smoke taste and the user experience are good.

Figure 1:
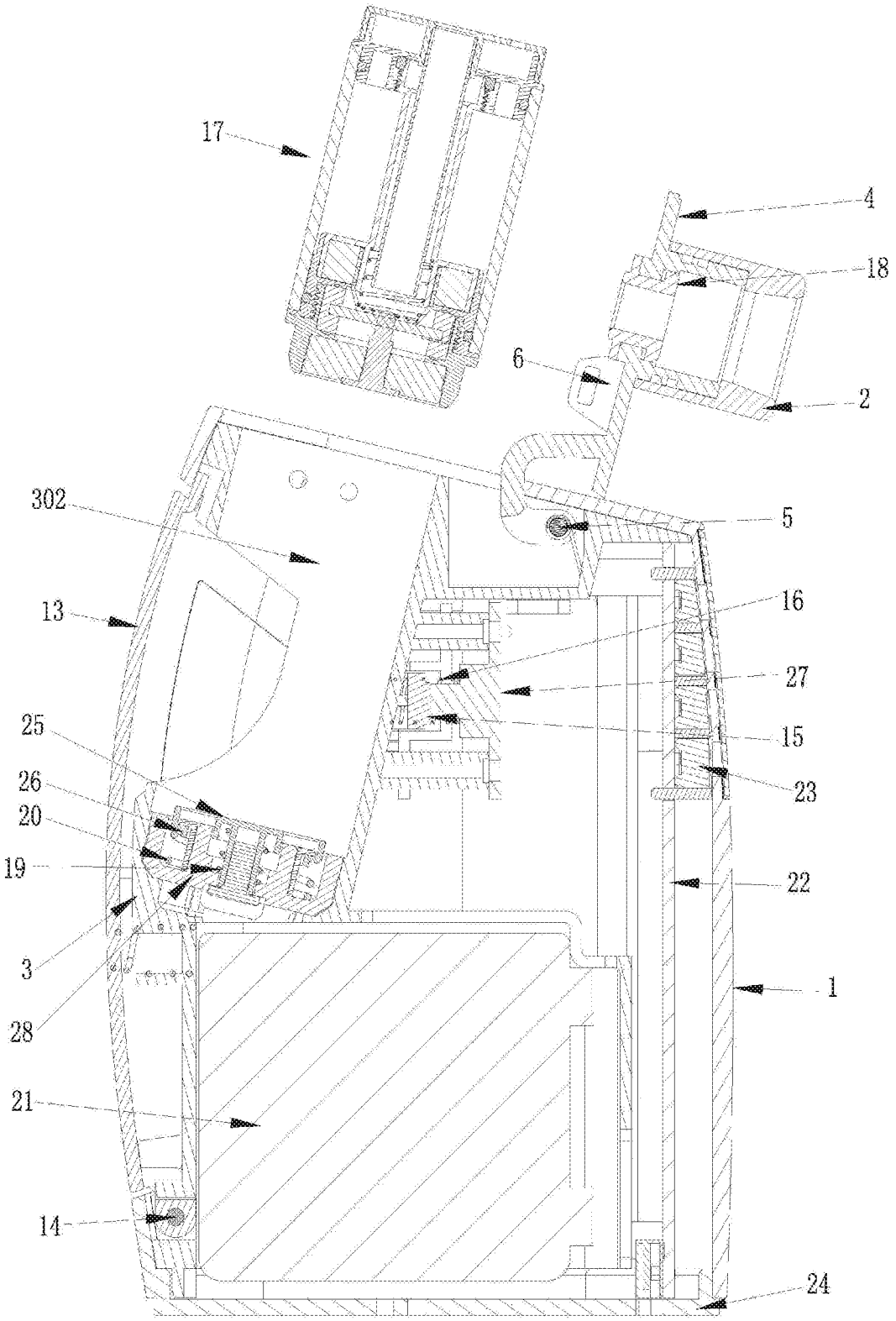
FIG. 1 is a main cross-sectional view of an embodiment of the present invention.
Figure 2:
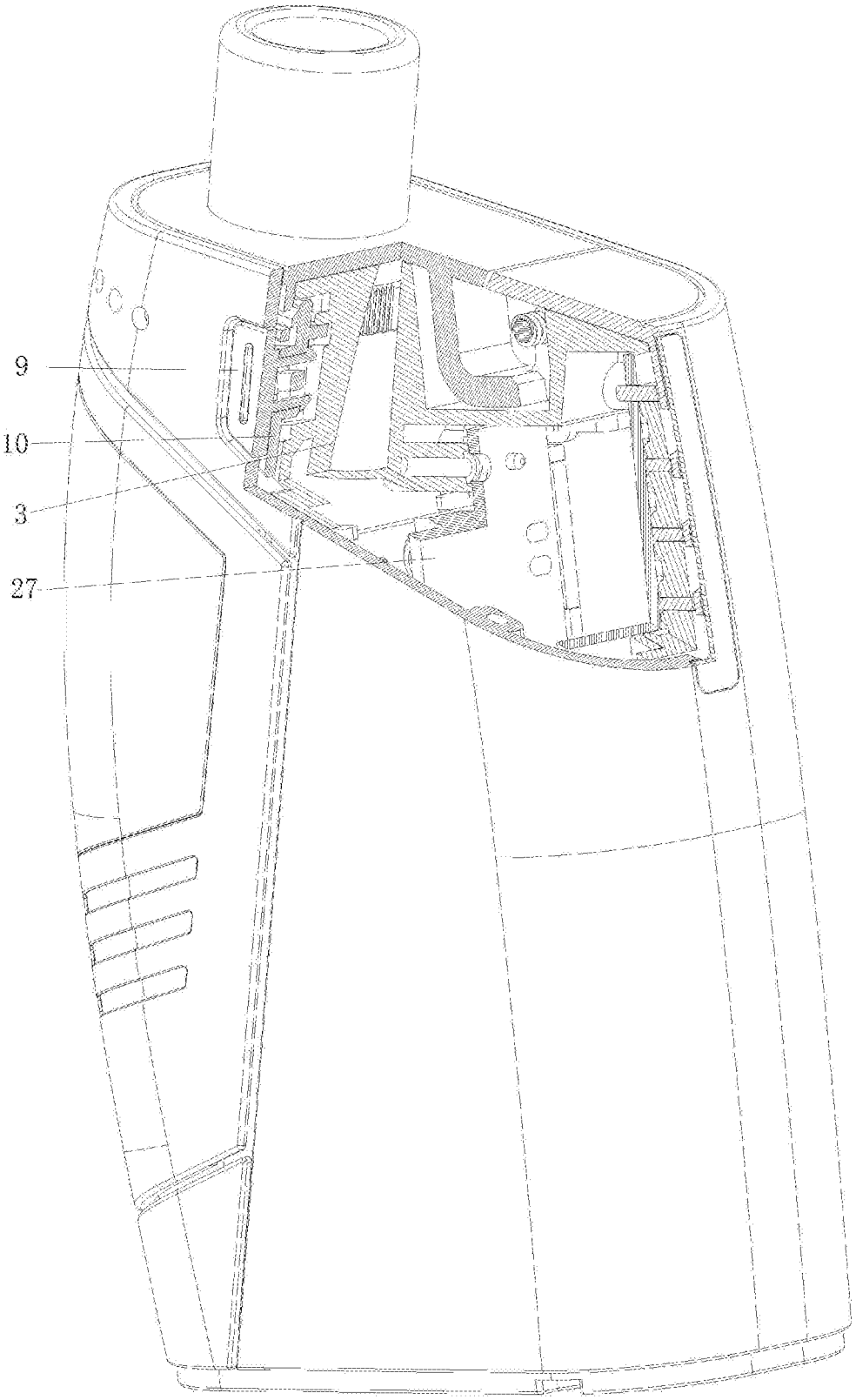
FIG. 2 is a schematic structural diagram when a key handle is pressed.
Figure 3:
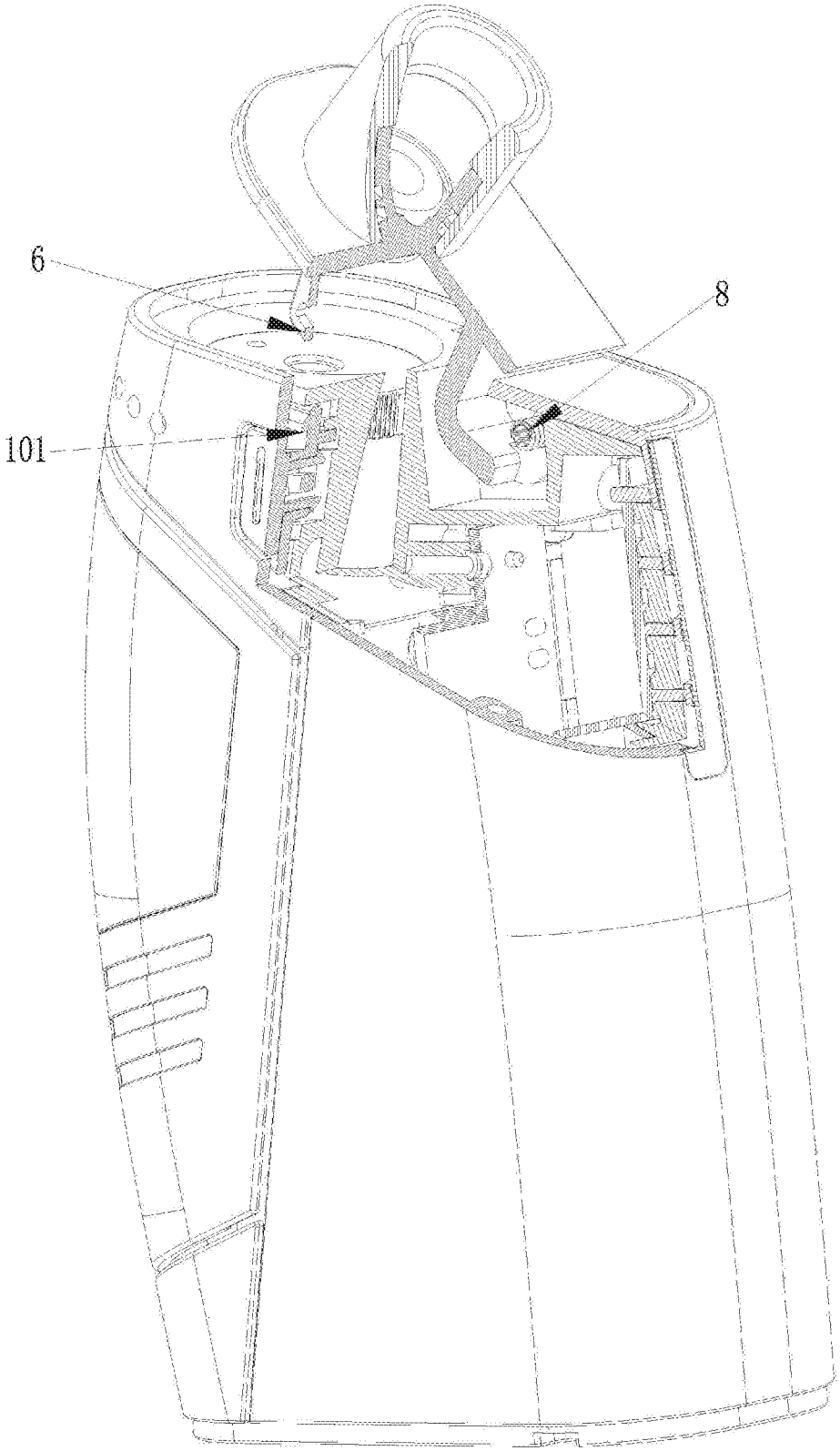
FIG. 3 is a schematic diagram of an open state of a top cover.
Figure 4:
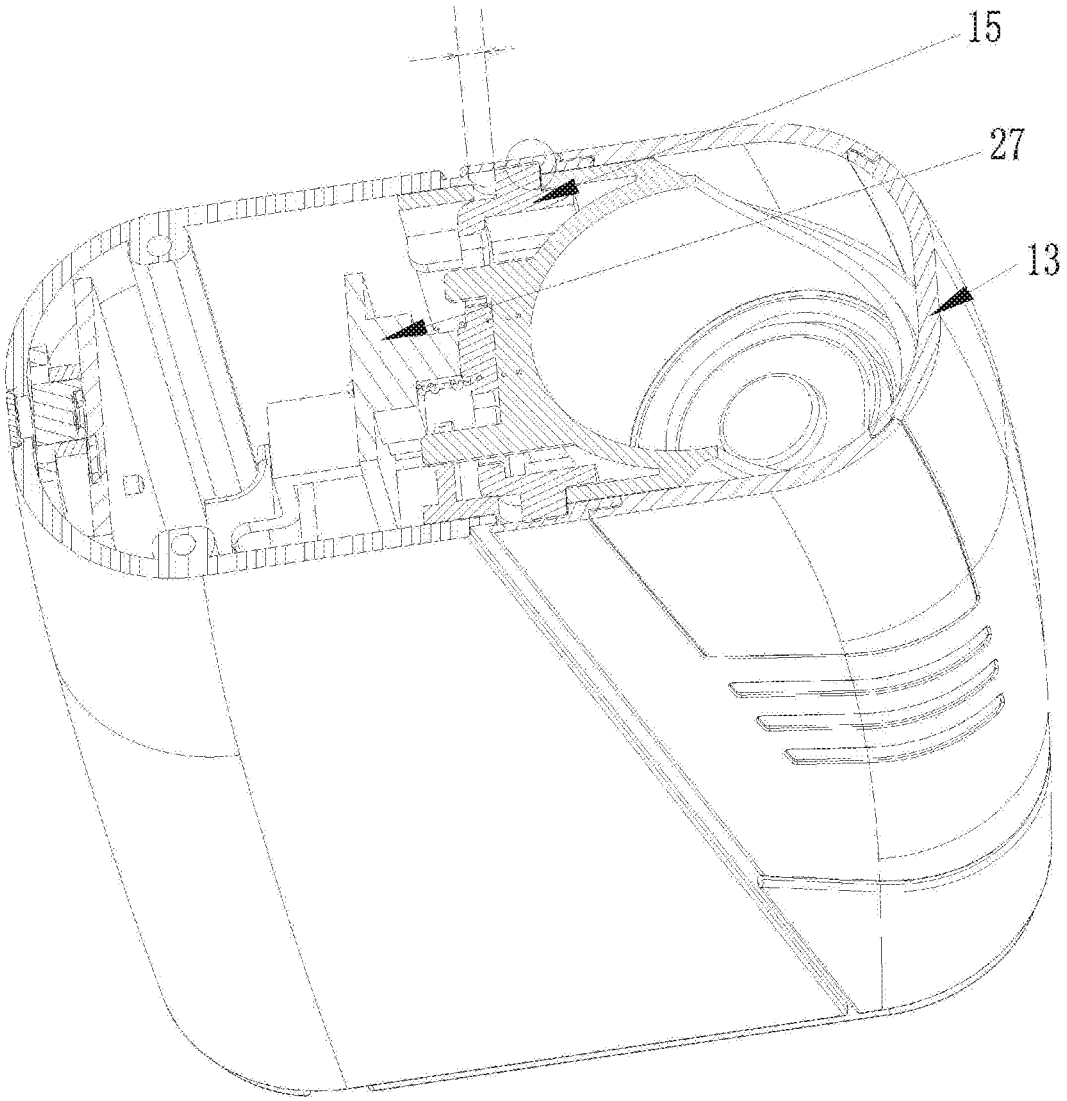
FIG. 4 is a schematic diagram of a connection relationship between a key PC board and a key shell.
Figure 5:
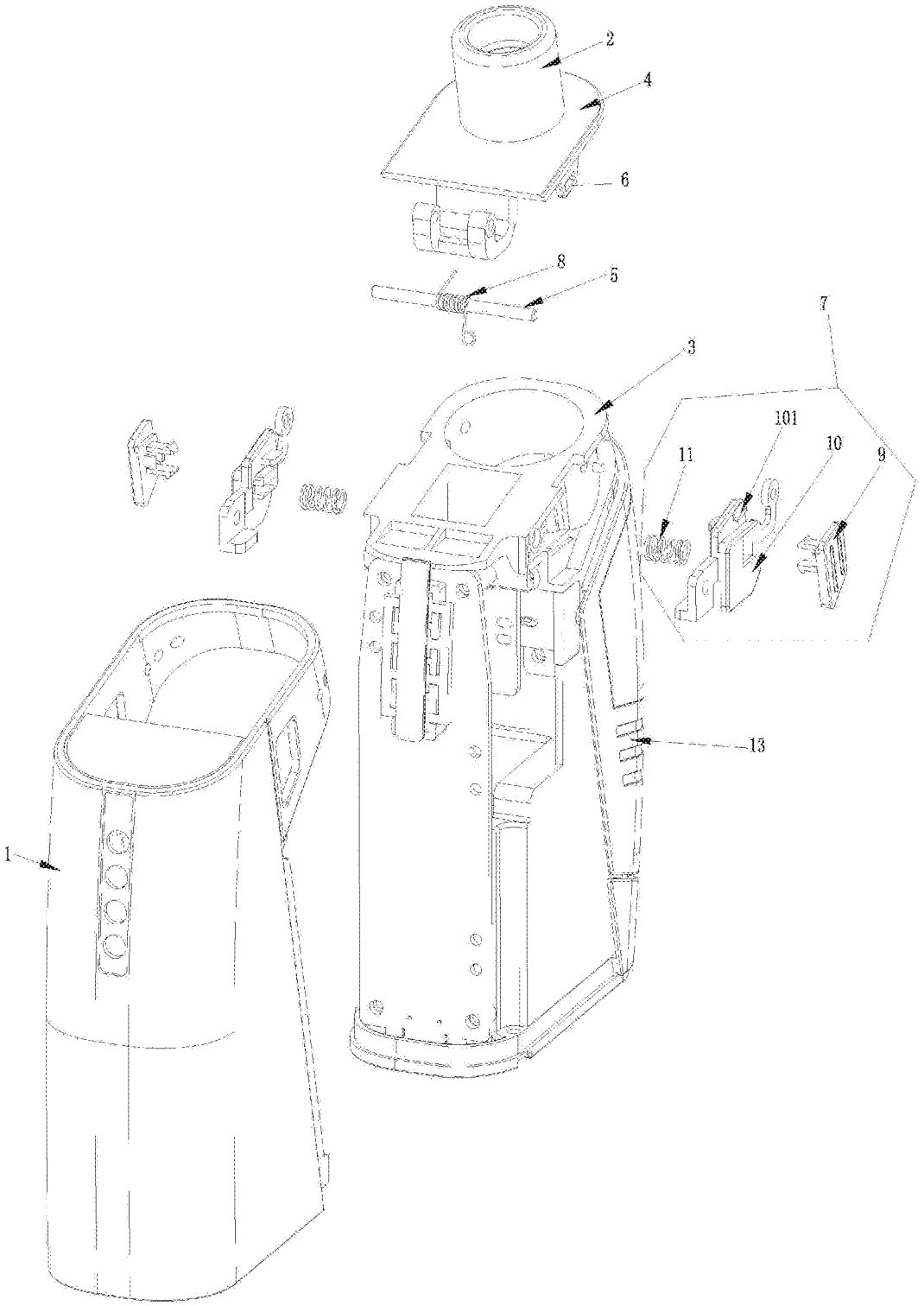
FIG. 5 is an exploded view of one part of FIG. 1.
Figure 6:
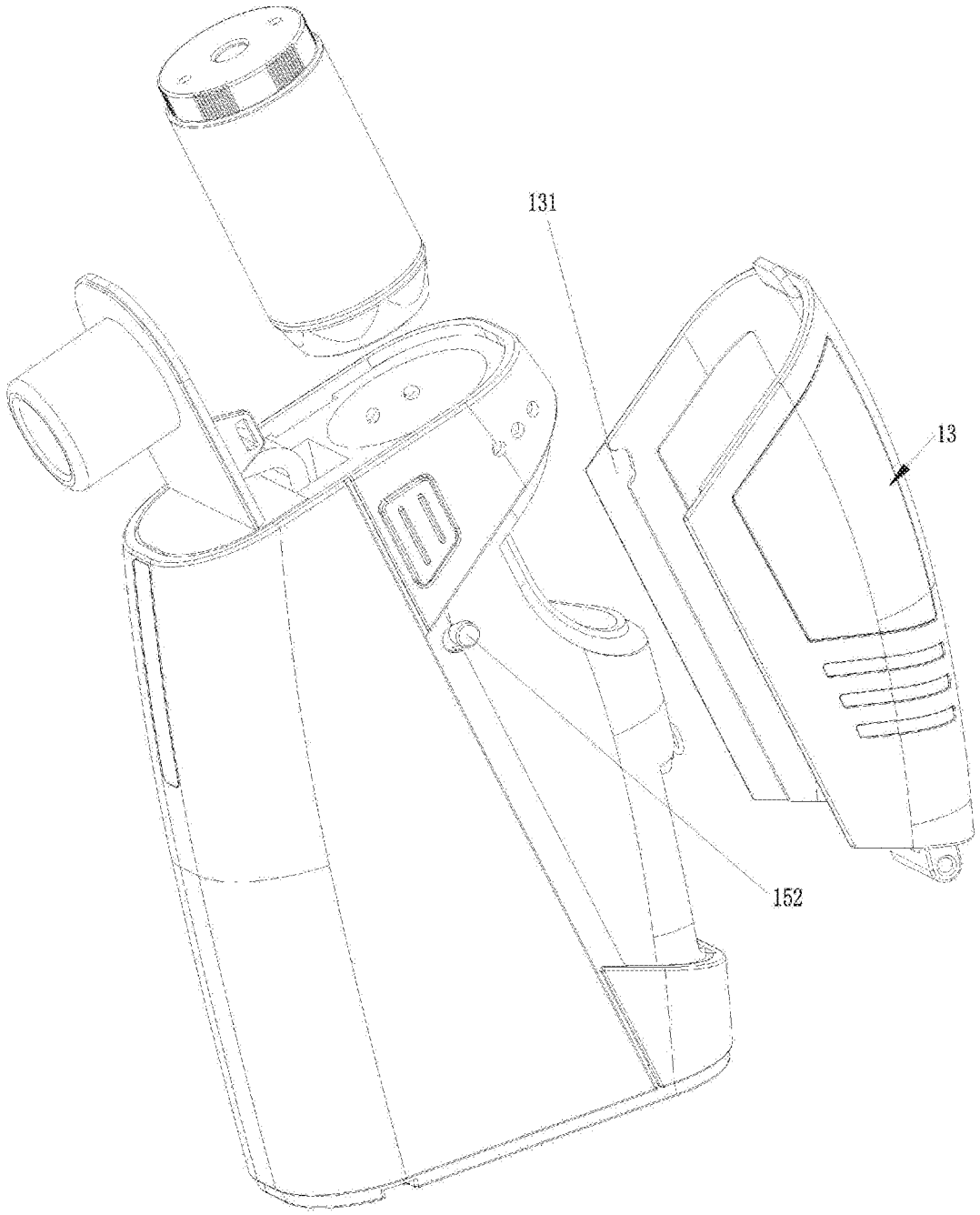
FIG. 6 is an exploded view of another part of FIG. 1.
Figure 7:
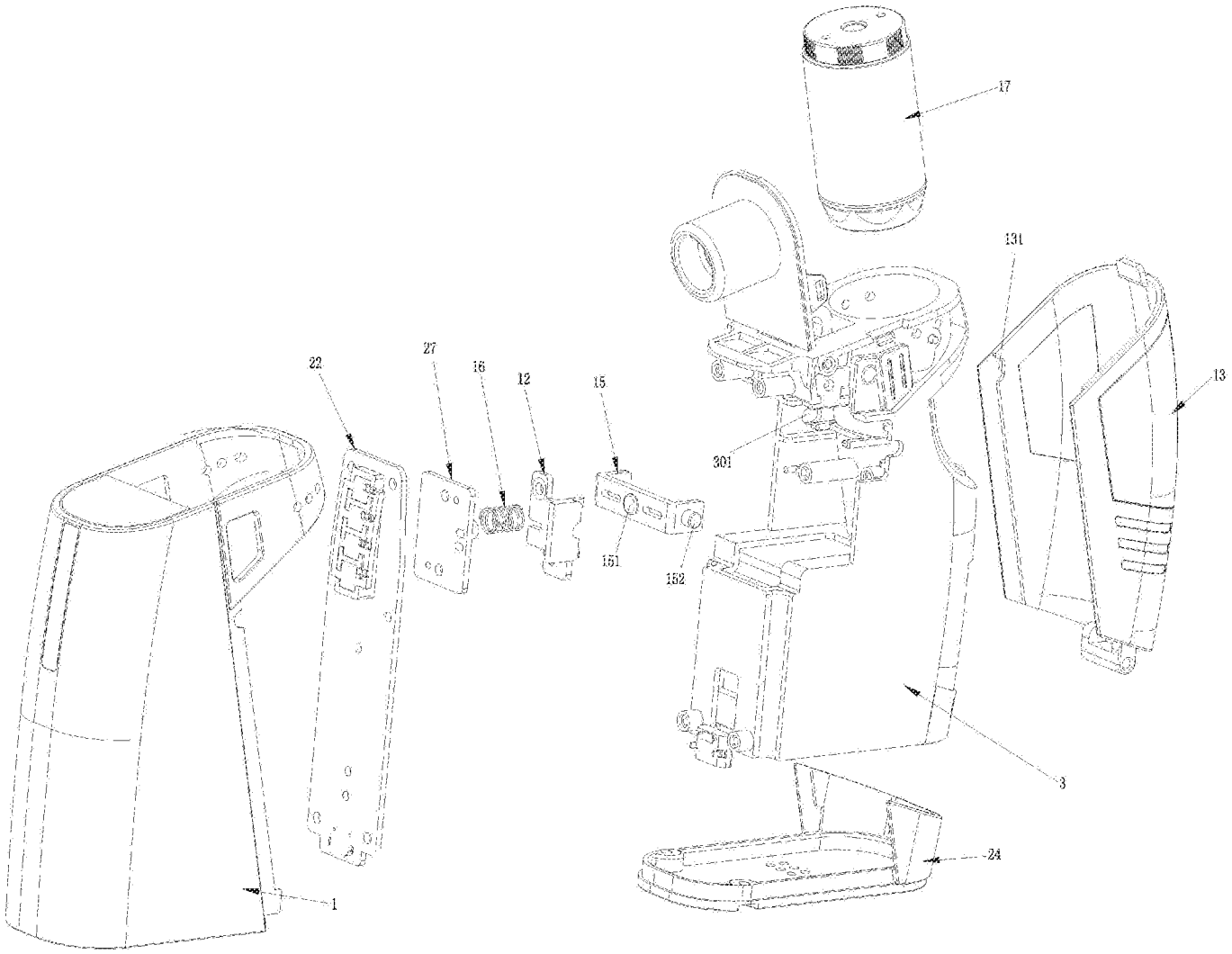
FIG. 7 is an exploded view of a part of FIG. 6.

In which, 1 housing, 2 suction nozzle, 3 support, 301 second groove, 302 receiving chamber, 4 top cover, 5 rotating shaft, 6 clamping rib, 7 locking mechanism, 8 elastic mechanism, 9 key handle, 10 transmission, 101 buckling portion, 11 first spring, 12 fixed block, 13 key shell, 131 first groove, 14 key shaft, 15 linkage block, 151 raised portion, 152 protrusion, 16 second spring, 17 atomization assembly, 1701 shell, 1702 liquid storage chamber, 1703 liquid storage cotton, 1704 cup-shaped liquid guiding cotton, 1705 ultrasonic atomization sheet, 1706 first tube, 17061 baffle portion, 170611 first through hole, 1707 second tube, 1708 connector, 17081 cavity, 17082 second through hole, 1709 channel, 1710 conductive ring, 1711 silicone seat, 1712 insulating seat, 1713 cotton compression spring, 18 gasket, 19 third spring, 20 fourth spring, 21 battery, 22 main board, 23 lamp panel, 24 bottom cover, 25 first electrode, 26 second electrode, 27 key PC board, 28 insulating ring.

DETAILED DESCRIPTION OF EMBODIMENTS

As shown in FIG. 1 to FIG. 7, an embodiment of the present invention, comprising a housing 1 and a suction nozzle 2, a support 3 is provided in the housing 1 a top cover 4 capable of sealing the housing 1 is further included, the suction nozzle 2 is disposed at the top of the top cover 4, one end of the top cover 4 is rotatably connected to the support 3 through a rotating shaft 5, a clamping rib 6 is disposed at the bottom of the top cover 4, and a locking mechanism 7 connected to the clamping rib 6 by locking is also disposed in the housing 1. The locking connection includes any connection means or connection construction such as magnet attracting connection and buckle connection, as long as the top cover 4 can stably cover an opening of the housing 1, and at least one end of the top cover 4 is connected to the housing 1 with any connection means or connection constructions when the opening of the housing 1 needs to be opened.

An elastic mechanism 8 for opening the top cover 4 when the locking mechanism 7 is separated from the clamping rib 6 is also disposed in the housing 1.

A preferred solution of this embodiment is that the elastic mechanism 8 includes a torsion spring 8 between the support 3 and the housing 1, and the torsion spring 8 is sleeved outside the rotating shaft 5. When the locking mechanism 7 locks the clamping rib 6, the top cover 4 seals the opening of the housing 1; and when the locking mechanism 7 unlocks the clamping rib 6, the elastic force of the torsion spring 8 opens the top cover 4.

A preferred solution of this embodiment is that the locking mechanism 7 includes a key handle 9, a transmission 10 and a first spring 11, and the transmission 10 has a buckling portion 101 corresponding to the clamping rib 6; the transmission 10 and the first spring 11 are disposed on the support 3, one end of the key handle 9 is connected to the transmission 10, and the other end of the key handle 9 passes through the housing 1 and is exposed. When the top cover 4 seals the opening of the housing 1, the buckling portion 101 and the clamping rib 6 are locked with each other; and when the key handle 9 is pushed inward, the key handle 9 drives the transmission 10 to move inward and causes the buckling portion 101 and the clamping rib 6 to be unlocked, and the key handle 9 compresses the first spring 11.

A preferred solution of this embodiment is that two clamping ribs 6 are symmetrically disposed at the bottom of the top cover 4, and two locking mechanisms 7 are correspondingly disposed in the housing 1.

A side panel of the housing 1 is a key shell 13 detachably connected to the housing 1, the bottom of the key shell 13 is rotatably connected to the support 3 through a key shaft 14, the upper part of the key shell 13 is connected to a linkage block 15 on the support 3 by transmission, the linkage block 15 is provided with a raised portion 151 capable of abutting against a key PC board 27, and a second spring 16 is disposed between the linkage block 15 and the key PC board 27. The portion that the strong hand pressing the key shell 13 and a switch on the key PC board 27 are basically on a straight line, so the force is uniform, and the transmission of the force is more direct; or if they are not on a straight line, an extending portion of the key shell 13 can be pressed by hand, and then the extending portion transmits the force to the switch on the key PC board 27, which can also achieve the same force effect on the switch of the key PC board 27, so multiple pressing methods can achieve uniform force and equivalent force effect on the switch of the key PC board 27.

Two first grooves 131 are symmetrically formed on two inner sides of the key shell 13, the linkage block 15 is provided with two protrusions 152 corresponding to the first grooves 131, and the support 3 is provided with two second grooves 301 corresponding to the protrusions 152.

A fixed block 12 is also disposed on the support 3, one of the two second grooves 301 is an oval groove formed in the support 3, and the other one of the two second grooves 301 is an oval groove formed by a semi-oval groove in the fixed block 12 and a semi-oval groove in the support 3.

The electronic cigarette further includes an atomization assembly 17, the support 3 is provided with a receiving chamber 302 for placing the atomization assembly 17, a first electrode 25 electrically connected to one pole of the atomization assembly 17 is disposed at the bottom of the receiving chamber 302, and a second electrode 26 electrically connected to the other pole of the atomization assembly 17 is disposed at the bottom of the receiving chamber 302. The first electrode 25 is connected to the second electrode 26 by insulation of an insulating ring 28.

The top cover 4 abuts against the first electrode 25 and the second electrode 26 through the atomization assembly 17. A gasket 18 capable of abutting against the top of the atomization assembly 17 is disposed on the top cover 4.

A third spring 19 is also disposed in the housing 1, one end of the third spring 19 abuts against the first electrode 25, and the other end of the third spring 19 abuts against the support 3.

A fourth spring 20 is also disposed in the housing 1, one end of the fourth spring 20 abuts against the second electrode 26, and the other end of the fourth spring 20 abuts against the support 3.

A battery 21, a main board 22 and a lamp panel 23 are also disposed in the housing 1, and a bottom cover 24 for sealing is disposed at the bottom of the housing 1.

Figure 8:
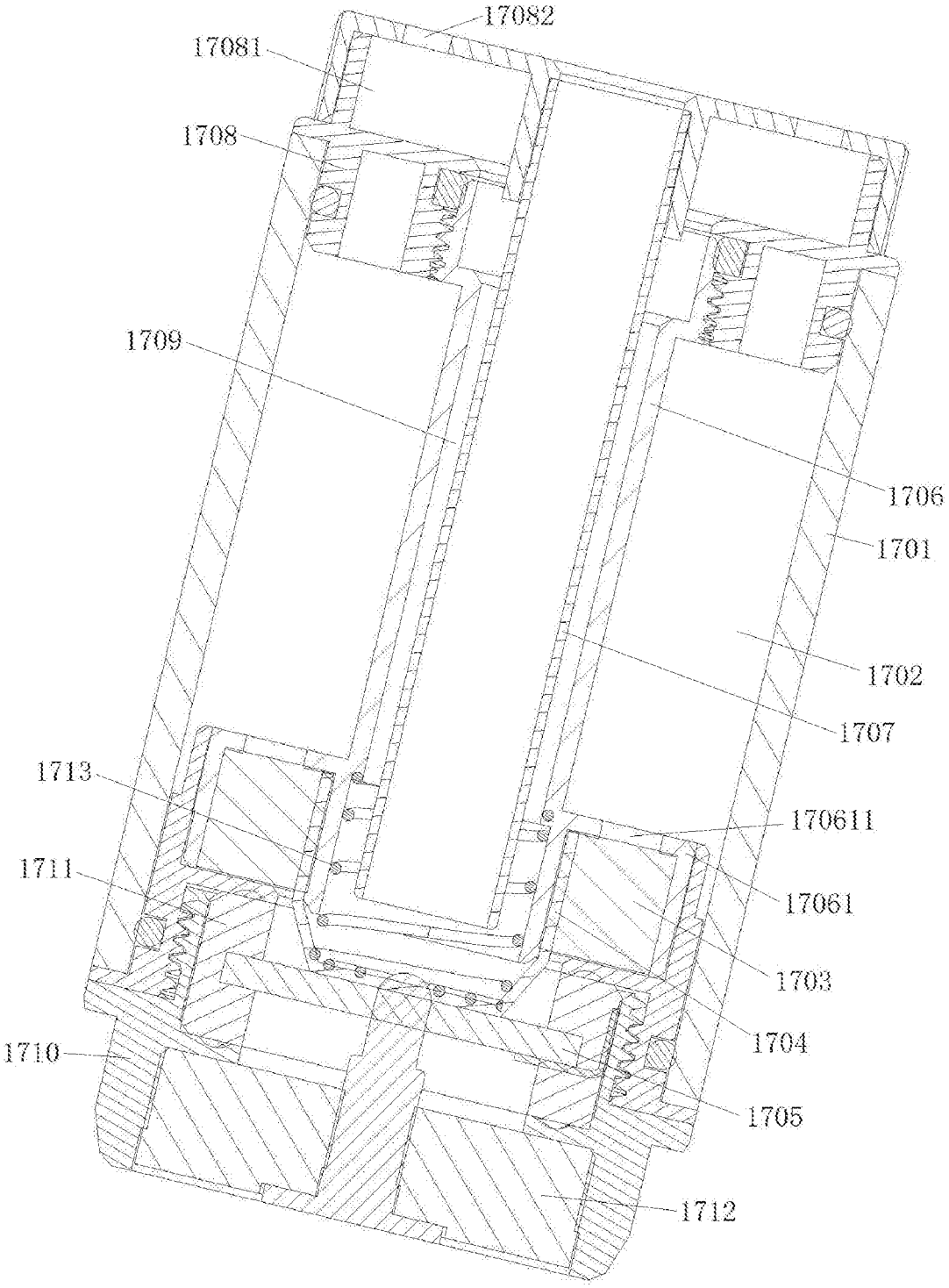
FIG. 8 is a schematic structural diagram of an atomization assembly.

As shown in FIG. 8, the atomization assembly 17 includes a shell 1701; a liquid chamber 1702, a liquid guiding mechanism 1703, 1704 and an ultrasonic atomization sheet 1705 are disposed in the shell 1701; the liquid chamber 1702 is communicated with an atomization surface of the ultrasonic atomization sheet 1705 through the liquid guiding mechanism 1703, 1704, one electrode layer of the ultrasonic atomization sheet 1705 is electrically connected to the first electrode 25, and the other electrode layer of the ultrasonic atomization sheet 1705 is electrically connected to the second electrode 26.

A first tube 1706 is also disposed in the shell 1701, the first tube 1706 has a baffle portion 17061 at one end, the liquid chamber 1702 is on one side of the baffle portion 17061, the liquid guiding mechanism 1703, 1704 is on the other side of the baffle portion 17061, and the liquid chamber 1702 is communicated with the liquid guiding mechanism 1703, 1704 only through a first through hole 170611 in the baffle portion 17061.

A second tube 1707 is disposed in the first tube 1706, the other end of the first tube 1706 and one end of the second tube 1707 are both connected to one end of the shell 1701 through a connector 1708, a cavity 17081 is formed in the connector 1708, the cavity 17081 is communicated with the outside through a second through hole 17082 in the connector 1708, a channel 1709 is formed between the first tube 1706 and the second tube 1707, and the cavity 17081, the channel 1709, the atomization surface of the ultrasonic atomization sheet 1705, the inner cavity of the second tube 1707, and the suction nozzle are communicated in sequence.

A conductive ring 1710 is connected to the bottom of the shell 1701, and the ultrasonic atomization sheet 1705 is disposed in the conductive ring 1710 through a silicone seat 1711.

An insulating seat 1712 is disposed in the conductive ring 1710, an elastic electrode passes through a through hole in the insulating seat 1712 and abuts against one electrode layer of the ultrasonic atomization sheet 1705, and the other electrode layer of the ultrasonic atomization sheet 1705 is electrically connected to the conductive ring 1710 by a wire.

When the top cover presses the atomization assembly, the elastic electrode abuts against the first electrode, and the conductive ring 1710 abuts against the second electrode, thus forming a stable and reliable electrical connection relationship.

The liquid guiding mechanism 1703, 1704 includes a liquid storage cotton 1703 and a cup-shaped liquid guiding cotton 1704, the liquid storage cotton 1703 is sleeved outside a side wall of the cup-shaped liquid guiding cotton 1704, and the liquid storage cotton 1703 is communicated with the liquid chamber 1702 through the channel 1709. The outer bottom surface of the cup-shaped liquid guiding cotton 1704 abuts against the atomization surface of the ultrasonic atomization sheet 1705.

The side wall of the cup-shaped liquid guiding cotton 1704 is sleeved outside the lower section of the first tube 1706, a cotton compression spring 1713 is disposed in the first tube 1706, one end of the cotton compression spring 1713 abuts against the first tube 1706, and the other end of the cotton compression spring 1713 abuts against the inner bottom surface of the cup-shaped liquid guiding cotton 1704.

The embodiments of the present invention are described above with reference to the drawings, but the present invention is not limited to the specific embodiments. The specific embodiments described above are merely illustrative but not restrictive. Many forms may also be made by those of ordinary skill in the art under the enlightenment of the present invention without departing from the purpose of the present invention and the scope of the claims, and these forms fall into the scope of the present invention.

The invention claimed is:

1. An electronic cigarette, comprising a housing (1) and a suction nozzle (2), wherein the housing (1) is provided with a support (3), and wherein:

the electronic cigarette further comprises a top cover (4) capable of covering the opening of the housing (1), the suction nozzle (2) is disposed at the top of the top cover (4), at least one end of the top cover (4) is rotatably connected to the support (3), a clamping rib (6) is disposed at the bottom of the top cover (4), and a locking mechanism (7) connected to the clamping rib (6) by locking is also disposed in the housing (1);

the electronic cigarette further comprises an atomization assembly (17), wherein: the support (3) is provided with a receiving chamber (302) for placing the atomization assembly (17), a first electrode (25) electrically connected to one pole of the atomization assembly (17) is disposed at the bottom of the receiving chamber (302), and a second electrode (26) electrically connected to the other pole of the atomization assembly (17) is disposed at the bottom of the receiving chamber (302);

wherein the top cover (4) abuts against the first electrode (25) and the second electrode (26) through the atomization assembly (17);

a third spring (19) is also disposed in the housing (1), one end of the third spring (19) abuts against the first electrode (25), and the other end of the third spring (19) abuts against the support (3).

2. The electronic cigarette according to claim 1, wherein an elastic mechanism (8) for opening the top cover (4) when the locking mechanism (7) is separated from the clamping rib (6) is also disposed in the housing (1).

3. The electronic cigarette according to claim 2, wherein:

at least one end of the top cover (4) is rotatably connected to the support (3) through a rotating shaft (5), the elastic mechanism (8) comprises a torsion spring (8) between the support (3) and the housing (1), and the torsion spring (8) is sleeved outside the rotating shaft (5).

4. The electronic cigarette according to claim 1, wherein:

the locking mechanism (7) comprises a key handle (9), a transmission (10) and a first spring (11), and the transmission (10) has a buckling portion (101) corresponding to the clamping rib (6);

the transmission (10) and the first spring (11) are disposed on the support (3), one end of the key handle (9) is connected to the transmission (10), and the other end of the key handle (9) passes through the housing (1) and is exposed.

5. The electronic cigarette according to claim 2, wherein:

the locking mechanism (7) comprises a key handle (9), a transmission (10) and a first spring (11), and the transmission (10) has a buckling portion (101) corresponding to the clamping rib (6);

the transmission (10) and the first spring (11) are disposed on the support (3), one end of the key handle (9) is connected to the transmission (10), and the other end of the key handle (9) passes through the housing (1) and is exposed.

6. The electronic cigarette according to claim 1, wherein two clamping ribs (6) are symmetrically disposed at the bottom of the top cover (4), and two locking mechanisms (7) are correspondingly disposed in the housing (1).

7. The electronic cigarette according to claim 1, wherein:

a side panel of the housing (1) is a key shell (13) detachably connected to the housing (1), the bottom of the key shell (13) is rotatably connected to the support (3) through a key shaft (14), the upper part of the key shell (13) is connected to a linkage block (15) on the support (3) by transmission, the linkage block (15) is provided with a raised portion (151) capable of abutting against a key PC board (27), and a second spring (16) is disposed between the linkage block (15) and the key PC board (27).

8. The electronic cigarette according to claim 2, wherein:

a side panel of the housing (1) is a key shell (13) detachably connected to the housing (1), the bottom of the key shell (13) is rotatably connected to the support (3) through a key shaft (14), the upper part of the key shell (13) is connected to a linkage block (15) on the support (3) by transmission, the linkage block (15) is provided with a raised portion (151) capable of abutting against a key PC board (27), and a second spring (16) is disposed between the linkage block (15) and the key PC board (27).

9. The electronic cigarette according to claim 3, wherein:

a side panel of the housing (1) is a key shell (13) detachably connected to the housing (1), the bottom of the key shell (13) is rotatably connected to the support (3) through a key shaft (14), the upper part of the key shell (13) is connected to a linkage block (15) on the support (3) by transmission, the linkage block (15) is provided with a raised portion (151) capable of abutting against a key PC board (27), and a second spring (16) is disposed between the linkage block (15) and the key PC board (27).

10. The electronic cigarette according to claim 7, wherein:

two first grooves (131) are symmetrically formed on two inner sides of the key shell (13), the linkage block (15) is provided with two protrusions (152) corresponding to the first grooves (131), and the support (3) is provided with two second grooves (301) corresponding to the protrusions (152).

11. The electronic cigarette according to claim 10, wherein:

a fixed block (12) is also disposed on the support (3), one of the two second grooves (301) is an oval groove formed in the support (3), and the other one of the two second grooves (301) is an oval groove formed by a semi-oval groove in the fixed block (12) and a semi-oval groove in the support (3).

12. The electronic cigarette according to claim 1, wherein:

a fourth spring (20) is also disposed in the housing (1), one end of the fourth spring (20) abuts against the second electrode (26), and the other end of the fourth spring (20) abuts against the support (3).

13. The electronic cigarette according to claim 1, wherein:

the atomization assembly (17) comprises a shell (1701);

a liquid chamber (1702), a liquid guiding mechanism (1703, 1704) and an ultrasonic atomization sheet (1705) are disposed in the shell (1701);

the liquid chamber (1702) is communicated with an atomization surface of the ultrasonic atomization sheet (1705) through the liquid guiding mechanism (1703, 1704);

one electrode layer of the ultrasonic atomization sheet (1705) is electrically connected to the first electrode (25); and the other electrode layer of the ultrasonic atomization sheet (1705) is electrically connected to the second electrode (26).

14. The electronic cigarette according to claim 1, wherein:

a first tube (1706) is also disposed in the shell (1701), the first tube (1706) has a baffle portion (17061) at one end, the liquid chamber (1702) is on one side of the baffle portion (17061), the liquid guiding mechanism (1703, 1704) is on the other side of the baffle portion (17061), and the liquid chamber (1702) is communicated with the liquid guiding mechanism (1703, 1704) only through a first through hole (170611) in the baffle portion (17061).

15. The electronic cigarette according to claim 14, wherein:

a second tube (1707) is disposed in the first tube (1706), the other end of the first tube (1706) and one end of the second tube (1707) are both connected to one end of the shell (1701) through a connector (1708), a cavity (17081) is formed in the connector (1708), the cavity (17081) is communicated with the outside through a second through hole (17082) in the connector (1708), a channel (1709) is formed between the first tube (1706) and the second tube (1707), and the cavity (17081), the channel (1709), the atomization surface of the ultrasonic atomization sheet (1705), the inner cavity of the second tube (1707), and the suction nozzle are communicated in sequence.

* * * * *